US010315730B2

(12) United States Patent
Baker

(10) Patent No.: US 10,315,730 B2
(45) Date of Patent: Jun. 11, 2019

(54) MARINE ANCHOR

(71) Applicant: Michael Arthur Baker, Donna Ann Baker and New Zealand Trustee Services Limited, Picton (NZ)

(72) Inventor: Michael Baker, Picton (NZ)

(73) Assignee: Michael Arthur Baker, Donna Ann Baker and New Zealand Trustee Services Limited, Picton (NZ)

( * ) Notice: Subject to any disclaimer, the term of this patent is extended or adjusted under 35 U.S.C. 154(b) by 16 days.

(21) Appl. No.: 15/572,711

(22) PCT Filed: May 9, 2016

(86) PCT No.: PCT/NZ2016/050072
§ 371 (c)(1),
(2) Date: Nov. 8, 2017

(87) PCT Pub. No.: WO2016/182453
PCT Pub. Date: Nov. 17, 2016

(65) Prior Publication Data

US 2018/0281904 A1 Oct. 4, 2018

(30) Foreign Application Priority Data

May 8, 2015 (NZ) ..... 707964

(51) Int. Cl.
*B63B 22/02* (2006.01)
*B63B 21/20* (2006.01)
*B63B 21/26* (2006.01)

(52) U.S. Cl.
CPC ..... *B63B 22/02* (2013.01); *B63B 21/20* (2013.01); *B63B 21/26* (2013.01); *B63B 2021/203* (2013.01)

(58) Field of Classification Search
CPC ..... B63B 20/02; B63B 21/20; B63B 21/26
See application file for complete search history.

(56) References Cited

U.S. PATENT DOCUMENTS 4,351,258 A 9/1982 Ray et al.
4,359,960 A 11/1982 Burchett et al.
5,004,272 A 4/1991 Kipp
(Continued)

FOREIGN PATENT DOCUMENTS

GB 2175623 A 12/1986

OTHER PUBLICATIONS

ISR and WO from International Bureau in related International Application No. PCT/NZ2016/050072 dated Dec. 28, 2016; 8 pages.

*Primary Examiner* — Stephen P Avila
(74) *Attorney, Agent, or Firm* — Mark Malek; Widerman Malek, PL

(57) ABSTRACT

An anchor comprises a substantially non-conducting housing including a series of collet apertures; flexible strands; collets; and a water bed engaging part. Each collet is adapted to engage one of the flexible strands and secure it in a respective one of the collet apertures of the housing. The anchor formed such that when it is in use the water bed engaging part can be located on the bed of a body of water with the strands extending upwards for use in securing an item at or near the surface of the water, the strands being able to expand and contract lengthwise to resist breaking due to pulling of the item.

13 Claims, 11 Drawing Sheets

(56) References Cited

U.S. PATENT DOCUMENTS

| | | | | |
|---|---|---|---|---|
| 5,054,963 | A | 10/1991 | Williamson | |
| 5,613,692 | A * | 3/1997 | Lloyd | B23B 31/202 279/2.03 |
| 6,719,497 | B1 | 4/2004 | Pollack et al. | |
| 2005/0271477 | A1 | 12/2005 | Sehl | |
| 2006/0016377 | A1* | 1/2006 | Chapman | B63H 9/0657 114/39.21 |
| 2011/0130057 | A1 | 6/2011 | Denise et al. | |
| 2013/0309020 | A1 | 11/2013 | Tomas et al. | |
| 2016/0189691 | A1* | 6/2016 | Hackett | G10D 1/08 84/298 |
| 2017/0292642 | A1* | 10/2017 | Pendleton | F16L 23/08 |

* cited by examiner

MARINE ANCHOR

CROSS REFERENCE TO RELATED APPLICATIONS

This is a utility patent application which claims the benefit of PCT/NZ2016/050072, filed on May 9, 2016, the contents of which are hereby incorporated by reference in its entirety.

FIELD OF INVENTION

The invention relates to an anchoring device for anchor floating marine structures.

BACKGROUND

Some structures are designed to float on water and be anchored to a fixed point. The fixed point may be a fixed anchor point on a sea floor, river bed or lake bed or may be a point on the shore or even another floating structure. Examples of a floating structures include buoys, mussel farms or recreational rafts fixed to the sea floor.

Floating structures are subject to forces that alter the distance between the structure and the fixed anchor point. For example structures in the sea are subject to wind, waves and tides. Structures in a lake are subject to wind and waves. Anchoring devices need to have some flexibility to allow for natural movement of the floating structure.

The term "comprising", if and when used in this document, should be interpreted non-exclusively. For example if used in relation to a combination of features it should not be taken as precluding the option of there being further unnamed features.

SUMMARY OF THE INVENTION

In broad terms in one aspect the invention comprises an anchoring device comprising: an anchor comprising

- a substantially non-conducting housing including a series of collet apertures;
- flexible strands;
- collets; and
- a water bed engaging part;

where each collet is engaged with a respective one of the flexible strands to secure it in a respective one of the collet apertures of the housing, the water bed engaging part being located on the bed of a body of water with the strands extending upwards to secure an item at or near the surface of the water, the strands being able to expand and contract lengthwise to resist breaking due to pulling of the item.

Preferably the anchor further comprises a second non-conducting housing including a series of collet apertures where each collet receives an end of a flexible strand and secures it in a respective one of the collet apertures of the housing and each flexible strand extends between the two housings.

Preferably the anchor further includes a connector releasably received in an aperture of the housing, the connector being attached to the anchor.

Preferably the connector is a mooring pin having a narrower portion passing through the aperture of the housing and having a portion wider than the aperture of the housing.

Preferably the mooring pin has an aperture in its wider portion.

Preferably the portion of the mooring pin that extends through the housing has at least one aperture.

Preferably a non-elastic strand is connected to the mooring pin through the aperture of the mooring pin.

Preferably the collets are substantially cylindrical.

Preferably one end of each collet is provided with a flange.

Preferably each collet is formed in two pieces.

Preferably the collets are formed from nylon.

Preferably the housing is formed from acetal.

In a further aspect of the invention there is an anchor comprising

- a non-conducting housing including a series of collet apertures and a housing aperture;
- a first mooring pin adapted to pass through the housing aperture;
- a second non-conducting housing including a series of collet apertures and a second housing aperture;
- a second mooring pin adapted to pass through the second housing aperture;
- flexible strands;
- collets; and
- a water bed engaging part;

where each collet is engaged with a respective one of the flexible strands to secure it in a respective one of the collet apertures of the housing and of the second housing, the water bed engaging part being located on the bed of a body of water with the strands extending upwards between housings to secure an item at or near the surface of the water, the strands being able to expand and contract lengthwise to resist breaking due to pulling of the item;

each pin having a narrower portion passing through the respective housing aperture and a portion wider than the respective housing aperture having an aperture in that wider portion, a non-elastic strand attached to each aperture in each wider portion so that each strand extends between the housings to restrict the extent of expansion of the strands.

DRAWINGS

The invention will be described in more detail with reference to the accompanying drawings in which.

DETAILED DESCRIPTION

Some preferred forms of the invention will now be described by way of example. It should be understood that these are not intended to limit the scope of the invention but rather to illustrate optional embodiments.

It should be noted that the marine anchor is not limited to sea environments. The marine anchor can be used in any suitable environment including the sea, rivers, lakes etc.

Figure 1:
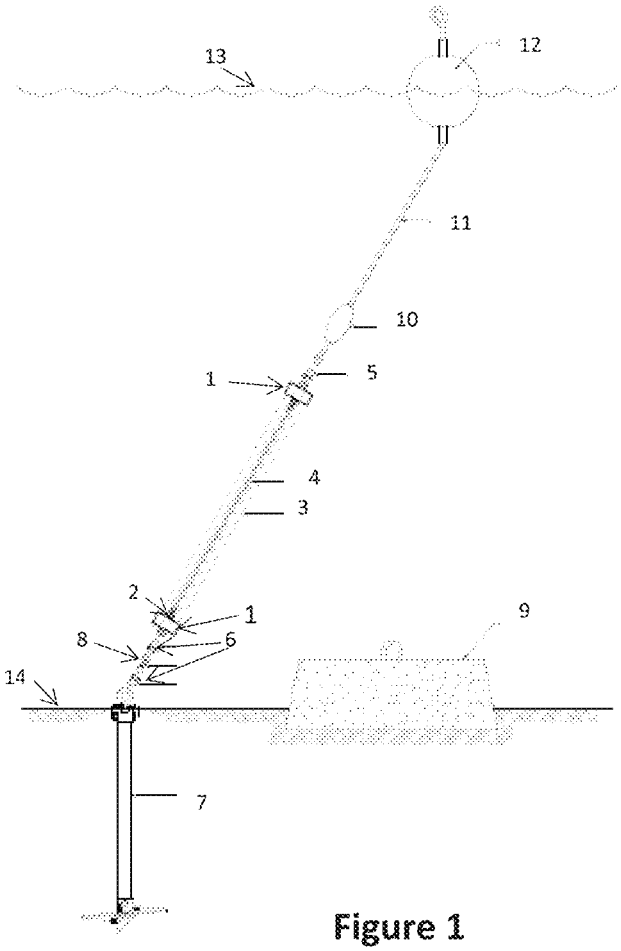
FIG. 1 shows a marine anchor of the invention in use in a marine setting.

FIG. 1 shows a marine anchor of the invention in use in a marine setting. The marine anchor includes housing 1, anchor pin 2, collets (not shown in this figure) and flexible strands 3. Flexible strands 3 extend through the collets and thereby through the housing 1. As shown in FIG. 1 housing 1 may be provided at each end of the anchor.

Figure 2A:
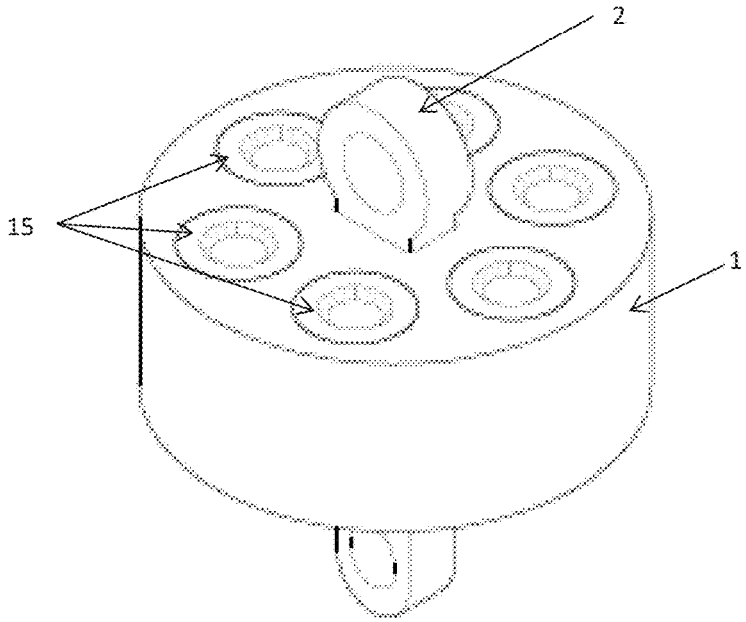
FIG. 2A is a top perspective view of a housing, anchor pin and collets.
Figure 2B:
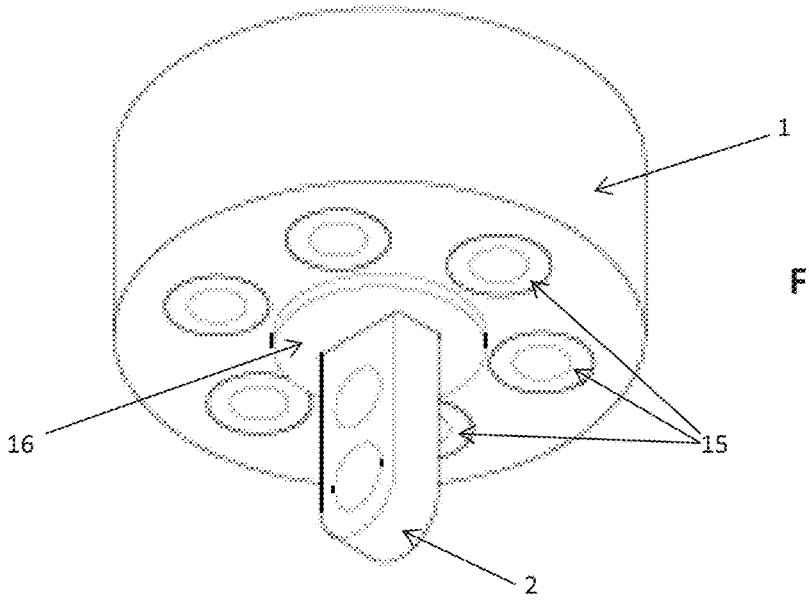
FIG. 2B is a bottom perspective view of a housing, anchor pin and collets.

Anchor pin 2 is adapted to pass through housing 1 (shown in more detail in FIGS. 2A and 2B). One end of anchor pin 2 includes an aperture. In use a connector may be positioned through the aperture and connected to further components. As can be seen in FIG. 1 bottom anchor pin 2 is adapted to be connected to shackle 6. Swivel 8 can then be connected to shackle 6. Another part of swivel 8 can be connected to screw anchor 7 through second shackle 6. Swivel 8 allows rotation of all parts above the swivel.

As shown in FIG. 1, screw anchor 7 is attached to the sea bed 14. In use the marine anchor can be connected to any suitable point. In most cases this will be a fixed point either underwater or at the water line. An alternative form of fixing is shown in FIG. 1 where mooring block 9 is shown on the sea bed.

The end of anchor pin 2 that extends through housing 1 may be connected to a non-elastic strand that extends between the housings. The non-elastic strand may be a rope for example. In embodiments where a non-elastic strand is provided the non-elastic strand will typically be longer than the elastic strands when the elastic strands are not under tension. Having the non-elastic strand longer than the elastic strands when the elastic strands are not under tension allows the elastic strands to elongate up to the length of the non-elastic strand. This provides a limit on the elongation of the elastic strands. In one embodiment the non-elastic strand may be a braided by-pass rope.

In some embodiments the marine anchor of the invention may extend all the way between the fixed anchor and the floating structure. In other embodiments the marine anchor may be attached to a non-elastic portion between the fixed anchor and floating structure. FIG. 1 shows the marine anchor of the invention attached to a non-elastic portion comprising lift buoy 10 and rope 11. The lift buoy prevents the marine anchor coming into contact with the ground materials during extreme low tides. Rope 11 may be any suitable rope.

Lifting buoy 10 is attached to the housing 1 through anchor pin 2 using shackle 5. One end of the rope 11 is attached to lifting buoy 10 and the other end is attached to a floating structure 12. In FIG. 1 floating structure 12 is a buoy that floats on the sea surface.

As can be seen in FIG. 1 the marine anchor allows the floating structure to move on the water surface in response to forces acting on the floating structure. The elastic strand(s) in the marine anchor will act to move the floating structure back to a position substantially above the fixed anchor when no forces are acting on the floating structure.

FIGS. 2A and 2B show perspective view of a housing 1 with anchor pin 2 in place and a plurality of collets 15.

Figure 6A:
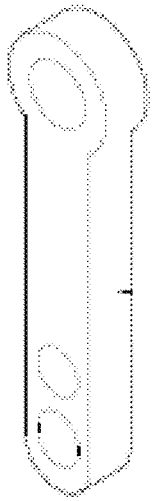
FIG. 6A is a perspective view of another anchor pin.
Figure 6B:
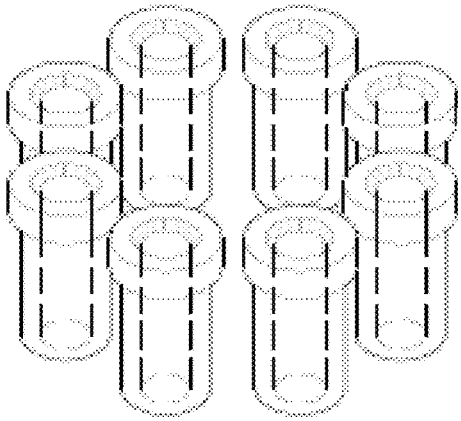
FIG. 6B is a perspective view of collets.
Figure 6C:
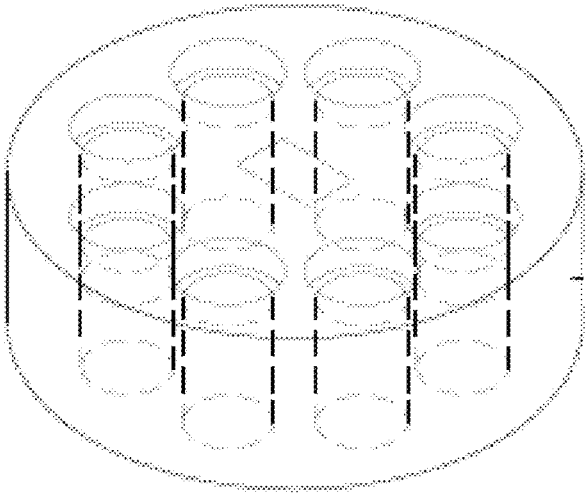
FIG. 6C is a perspective view of another housing.
Figure 6D:
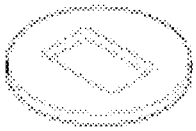
FIG. 6D is a perspective view of a washer.
Figure 7A:
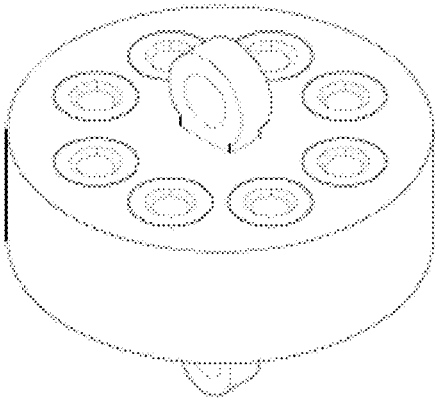
FIG. 7A is a top perspective view of a housing, anchor pins and collets.
Figure 7B:
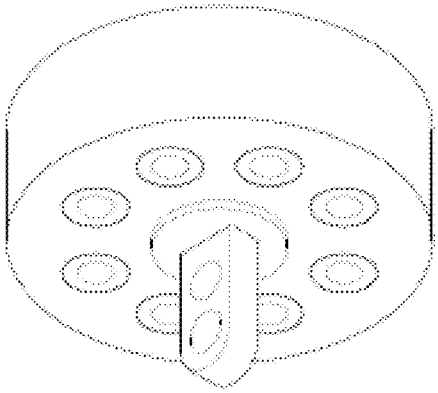
FIG. 7B is a bottom perspective view of a housing, anchor pins, collets and washer.

To survive in a marine environment housing 1 is formed form non-corrosive material. In preferred embodiments housing 1 is formed from a non-corrosive material such as acetal. Forming the housing from a non-corrosive material such as acetal provides good resistance to corrosion from salt water and durability. The housing includes a number of first apertures that extend through the housing and are designed to house collets 15. There are six collet apertures shown in FIGS. 2A and 2B but this number may differ. For example FIGS. 6A and 6B show a housing with eight collet apertures. The number of collet apertures may vary depending on the intended use of the marine anchor. As an example marine anchors for floating jetties may require more collet apertures than a marine anchor for a single small buoy. The invention is not limited by the number of collet apertures. Further, the collet apertures need not be provided in a circle around a central aperture. For example, two circles of collet apertures could be provided. Alternatively the collets could be provided in a single row.

Housing 1 is shown as substantially cylindrical but this should not be seen as limiting. Any suitable shape housing may be used.

As can be seen in FIGS. 2A and 2B collets 15 are designed to sit within the apertures of the housing. In preferred embodiments the collets are formed from nylon but alternatively may be formed from any suitable material.

Anchor pin 2 extends through housing 1 through a second aperture. In some embodiments washer 16 is provided for the bottom of housing 1 around the second aperture.

Figure 3A:
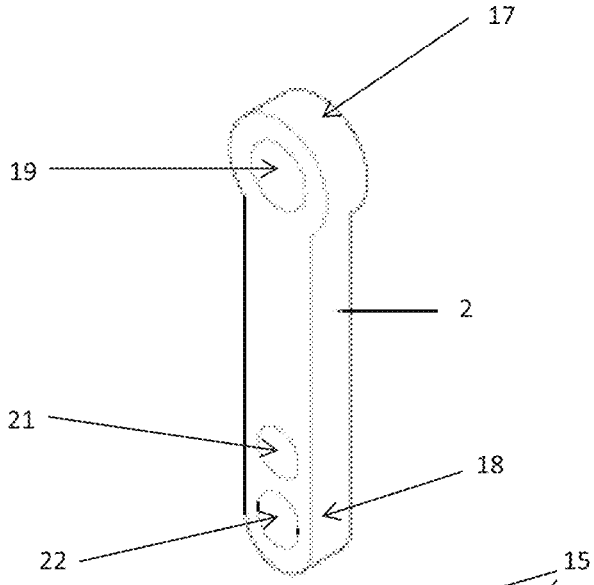
FIG. 3A is a perspective view of an anchor pin.

FIG. 3A shows one embodiment of anchor pin 2 in more detail. Anchor pin 2 includes wider portion 17 that is dimensioned to be too large to pass through the anchor pin aperture in the housing. Anchor pin 2 also includes narrower portion 18 that is dimensioned to pass through the anchor pin aperture in the housing. The wider portion 17 of anchor pin 2 includes at least one aperture 19. The aperture 19 is dimensioned to allow a fixing device (such as a shackle like that shown in FIG. 1) to be attached to the anchor pin and further attached to other components. The other components may include further fixing components, non-elastic strands or any suitable components.

Although aperture 19 is shown to be circular in FIG. 3A this should not be seen as limiting. In other embodiments the aperture may be oval, elliptical or any other suitable shape.

The narrower portion of anchor pin 2 includes at least one aperture 20. The aperture is dimensioned to allow a fixing device to be attached to the anchor pin and further components. The anchor pin shown in FIG. 3A may include a second aperture 21. In some embodiments aperture 21 is designed to hold a bolt to prevent anchor pin 2 from sliding out of housing 1. In preferred embodiments the anchor pin is formed from a non-corrosive metal. Examples of suitable metals include stainless steel and titanium.

Figure 3B:
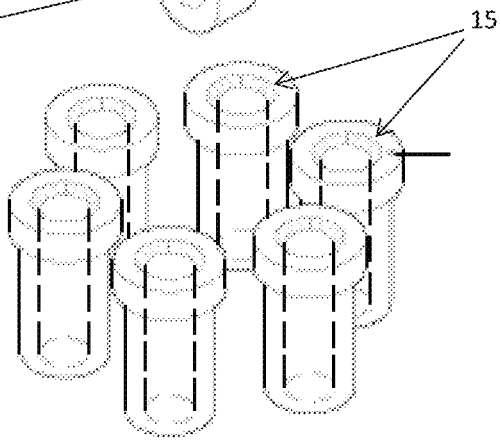
FIG. 3B is a perspective view of the collets.
Figure 3C:
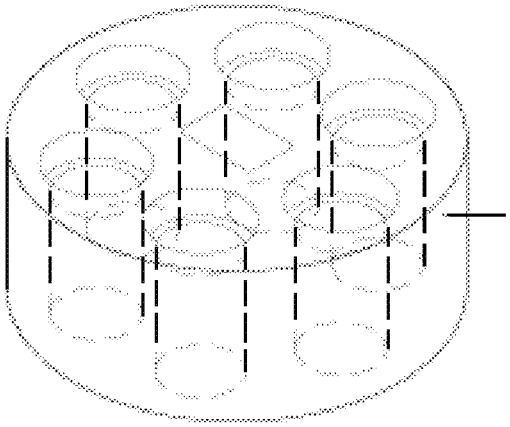
FIG. 3C is a perspective view of the housing.
Figure 3D:
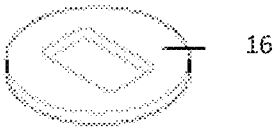
FIG. 3D is a perspective view of a washer.

FIG. 3D shows a washer 16 that may be placed around the anchor pin aperture in housing 1. If a bolt (or the like) is used with anchor pin 2 washer 16 may prevent or limit damage to the housing from the bolt. Ideally the central aperture of the washer has the same cross-section as the anchor pin aperture in the housing.

FIG. 3B shows some collets 15. Collets 15 include a central aperture that extends through the collet and is parallel to the collet housing aperture when the collet is in the housing. In preferred embodiments the collets are substantially cylindrical. As can be seen in FIG. 3B the collets may have a larger diameter at one end of the collet. In this embodiment a mating section is formed in the housing collet apertures. This embodiment allows the collets to be slid into the housing in only one direction to fit snugly into the collet apertures of the housing.

The internal aperture of the collet may be substantially cylindrical. As shown in FIG. 3B (and FIG. 5B) the internal aperture of the collet may be bevelled at each end. Bevelling the collet helps to prevent wear on elastic strands when positioned in the collet.

Figure 4:
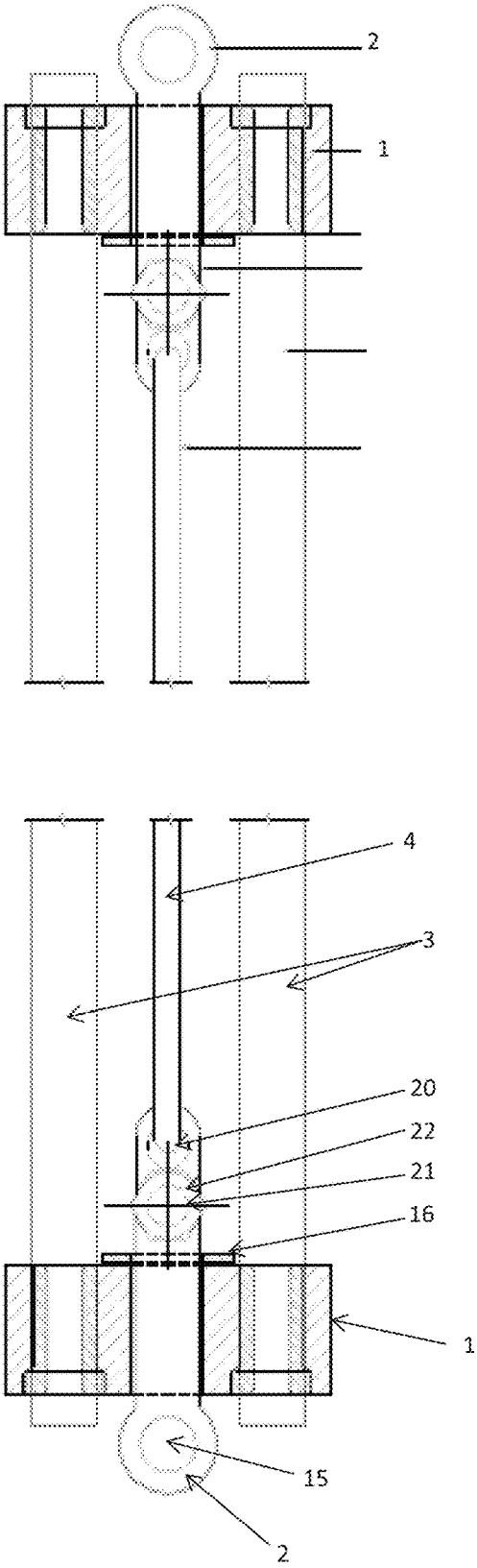
FIG. 4 is cutaway view of the marine anchor.

FIG. 4 shows a marine anchor of the invention with two housings, two anchor pins and a plurality of collets and elastic strands. Both housings contain the same number of collets and collet apertures. As can be seen in FIG. 4 washer 16 is in place around anchor pin 2 and between housing 1 and bolt 22. Bolt 22 is positioned through aperture 21.

A plurality of flexible elastic strands 3 extend between the collets of the two housings. Each elastic strand extends through a collet at each end. Ideally the elastic strands are formed from rubber. In some embodiments the elastic strands are hollow. The elastic strands can be elongated. As the strands are elongated the diameter of the strand decreases.

Figure 5A:
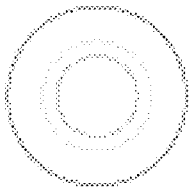
FIG. 5A is a top view of a collet.
Figure 5B:
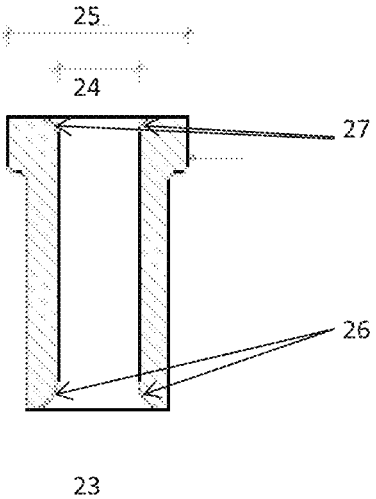
FIG. 5B is a side view of a collet piece.

The lengths of the elastic strands will be determined by the distance the marine anchor needs to span In FIG. 4 the elastic strands 3 are not elongated. As can be seen in FIG. 4 the diameter of the non-elongated elastic strands is wider than the smallest internal diameter of the collets. This means that the portion of the elastic strands within the collet is exerting a force on the inside the collet trying to expand the collet against the housing. As the smallest internal diameter of the collet is less than the non-elongated diameter of the elastic strand, the elastic strand cannot slip out of the collet. In preferred embodiments of the invention the diameter of the elastic strand when it is not elongated is larger than the diameter of the collet apertures in the housing FIG. 4 also shows a non-elastic strand 4 extending between apertures 20 of the anchor pins 2. Non-elastic strand 4 may be connected to through aperture 20 by any suitable means. Non-elastic strand 4 will generally be longer than the un-elongated elastic strands. The longest the elastic strands should be able to be elongated is such that the smallest allowable diameter of the elongated elastic strand is greater than the smallest internal diameter of the collet. The length of the non-elastic strand may be such to prevent the elastic strands from elongating too far To insert an elastic strand into a collet the end of the elastic strand is elongated causing the diameter to decrease. The strand is fed through the housing. The collet can then be slipped around the end of the elastic strand holding the shape of the elastic strand within the collet. FIGS. 5A and 5B show a top view and a side view of a collet respectively. In preferred embodiments the collets are formed of two semi-cylindrical pieces as shown in FIG. 5B. When the collets are formed in two (or more) pieces then the collets can be more easily placed around the elongated elastic strand. Once the collet pieces are in place the collet can be slid into the housing and the elongated strand unstretched.

FIG. 5B shows one piece of a two piece collet (or the cross-section of a single piece collet). As can be seen in FIG. 5B the collet has a smallest internal diameter 24 sized to be smaller than the non-elongated diameter of the elastic strands. The collet also has external diameter 23 sized to fit snugly into the collet apertures of the housing. The collet may have wider flange 25 shaped to fit into a corresponding portion of the collet aperture in the housing. The wider flange part of the collet and corresponding portion of the collet aperture allows the collet to be positioned into the aperture in only one way. In use the flange side of the collets are positioned with the ends of the elastic strands through them so that as the strands stretch the flange prevents the collets from pulling through the collet apertures.

The collets may also be provided with bevels 26 and 27 at each end of the collet aperture. The collet bevels help to reduce wear on the elastic strands.

In preferred embodiments the collets extend all the way through the collet apertures in the housing. This prevents wear on the elastic strands from the housing.

In one example embodiment the internal diameter of the collets are 27 mm. When relaxed the diameter of the flexible elastic strands is 40 mm. To fit the collets to the elastic strands the elastic strands need to be stretched 300% to reduce the diameter of the strands to the internal diameter of the collets. Once the collets are in place in the housing the strands can be relaxed.

FIGS. 6A to D and FIGS. 7A and 7B show housings with eight collets and collet housings. It should be appreciated that any number and arrangement of collets and collet housings can be used.

FIG. 8A shows another embodiment of collet housing. This housing has eight apertures for receiving collets as well as a central aperture for an anchor pin. As can be seen in FIG. 8A the outside of the collet housing is not cylindrical but rather is shaped around the collet apertures. Any suitable collet housing shape may be used.

Figure 9:
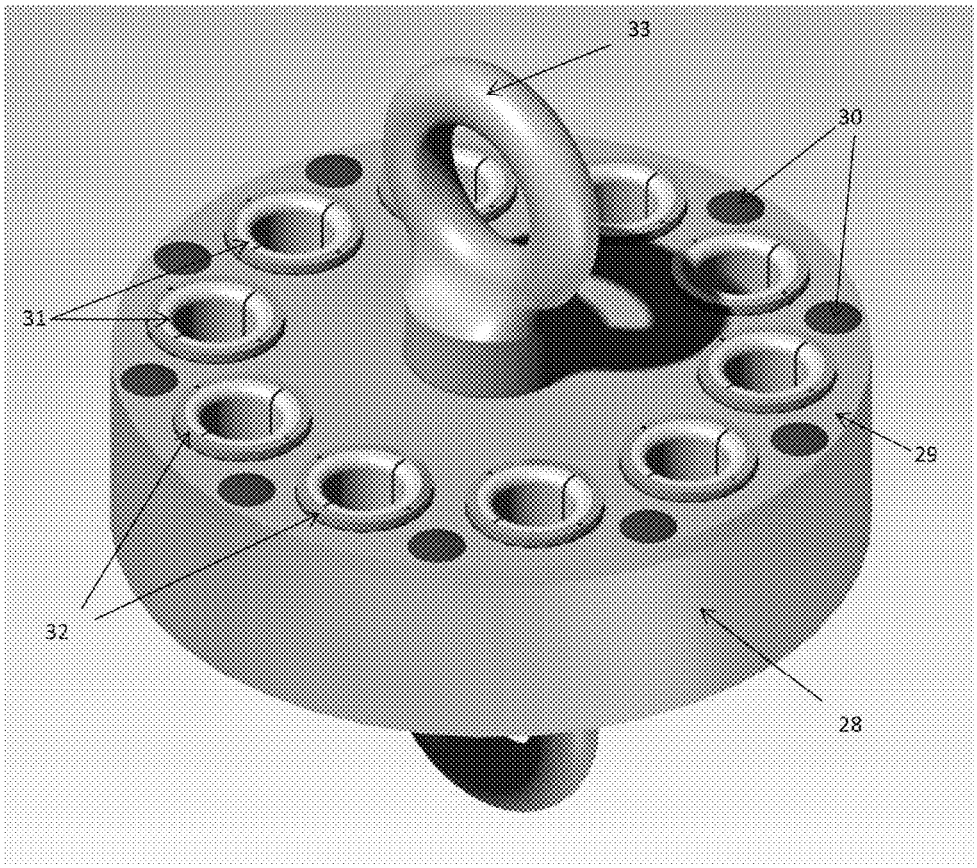
FIG. 9 is a perspective view a collet housing with collets and an anchor pin.

FIG. 9 shows a two-piece collet housing with 10 collets. The housing has first piece 28 and second piece 29. The first and second pieces of the collet housing are held together by fixing means 30. The collets 31 are surrounded by collet sleeves 32. Anchor pin 33 extends from either side of a central aperture in the housing.

Figure 10:
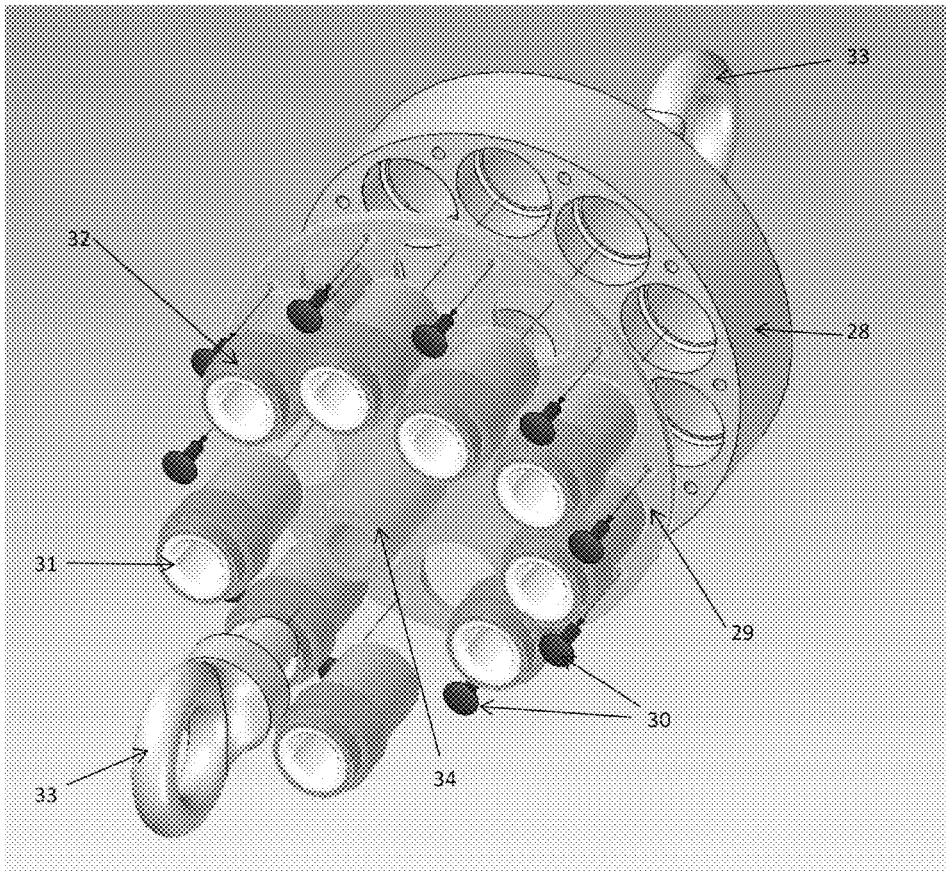
FIG. 10 is an exploded view of a collet housing.

FIG. 10 is an exploded view of a collet housing, collets, anchor pin and fastening means similar to the housing of FIG. 9. The collet housing of FIG. 10 is configured to receive nine collets. The collet housing comprises first piece 28 and second piece 29. The two pieces of the collet housing are connected together by fixing means 30. The fixing means may be screws or any other suitable device. Collets 31 can be surrounded by collet sleeves to improve the durability of the collets and the flexible strands (not shown) that extend through the collets when the anchor is in use. Anchor pins 33 extend through both sides of the collet housing and into central cylinder 34. Anchor pins 33 are shown as a two piece anchor pin. Each piece of the anchor pin is placed into the central aperture through the housings 28 and 29. When the housings are connected by the fixing means 30 the anchor pin is locked and place and cannot be pulled out of the collet housing.

Figure 8:
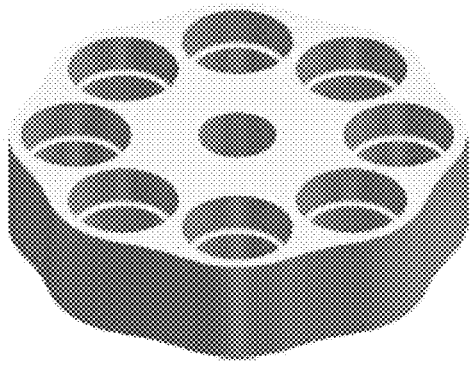
FIG. 8 is a perspective view of another housing.
Figure 11:
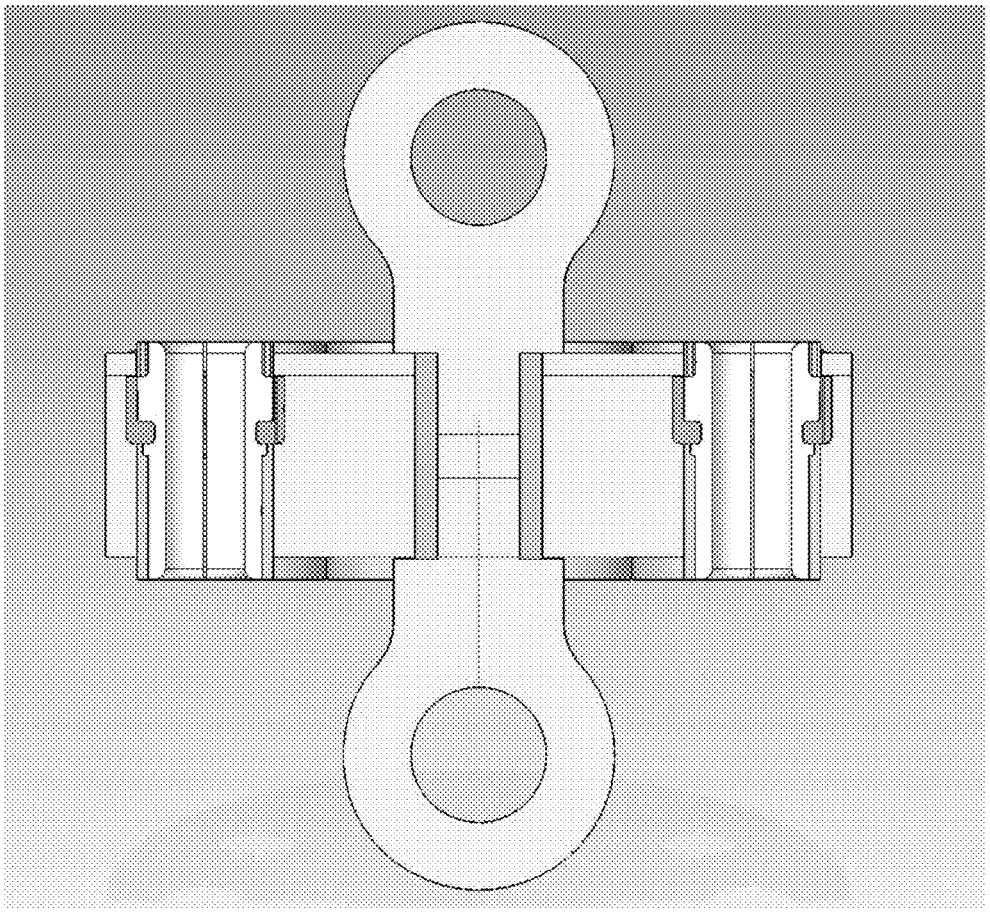
FIG. 11 is a cut away view of a collet housing and anchor pin.

FIG. 11 is a cut away view of a collet housing showing a two piece anchor pin as used in FIGS. 8 to 10.

In the claims which follow and in the preceding description of the invention, except where the context requires otherwise due to express language or necessary implication, the word "comprise" or variation such as "comprises" or "comprising" is used in an inclusive sense, i.e. to specify the presence of the stated features but not to preclude the presence or addition of further features in various embodiments of the invention.

While some preferred aspects of the invention have been described by way of example it should be appreciated that modifications and improvements can occur without departing from the scope of the invention.

The invention claimed is:

1. An anchor comprising a substantially non-conducting housing including a series of collet apertures;

flexible strands;

collets; and water bed engaging part;

wherein each collet is engaged with a respective one of the flexible strands to secure it in a respective one of the collet apertures of the housing, the water bed engaging part being located on the bed of a body of water with the strands extending upwards to secure an item at or near the surface of the water, the strands being able to expand and contract lengthwise to resist breaking due to pulling of the item.

2. The anchor according to claim 1 further comprising:

a second non-conducting housing including a series of collet apertures;

wherein each collet receives an end of a flexible strand and secures it in a respective one of the collet apertures of the housing and each flexible strand extends between the two housings.

3. The anchor according to claim 2 further including a connector releasably received in an aperture of the housing, the connector being attached to the anchor.

4. The anchor according to claim 3 wherein the connector is a mooring pin having a narrower portion passing through the aperture of the housing and having a portion wider than the aperture of the housing.

5. The anchor according to claim 4 wherein the mooring pin has an aperture in its wider portion.

6. The anchor according to claim 5 wherein the portion of the mooring pin that extends through the housing has at least one aperture.

7. The anchor according to claim 6 wherein a non-elastic strand is connected to the mooring pin through the aperture of the mooring pin.

8. The anchor according to claim 1 wherein the collets are substantially cylindrical.

9. The anchor according to claim 8 wherein one end of each collet is provided with a flange.

10. The anchor according to claim 9 wherein each collet is formed in two pieces.

11. The anchor according to claim 10 wherein the collets are formed from nylon.

12. The anchor according to claim 11 wherein the housing is formed from acetal.

13. An anchor comprising:

a non-conducting housing including a series of collet apertures and a housing aperture;

a first mooring pin adapted to pass through the housing aperture;

a second non-conducting housing including a series of collet apertures and a second housing aperture;

a second mooring pin adapted to pass through the second housing aperture;

a plurality of flexible strands;

a plurality of collets; and a water bed engaging part;

wherein each of the plurality of collets is engaged with a respective one of the plurality of flexible strands to secure it in a respective one of the collet apertures of the housing and of the second housing, the water bed engaging part being located on a bed of a body of water with the plurality of flexible strands extending upwards between the first non-conducting housing and the second non-conducting housing to secure an item at or near a surface of the water, the plurality of flexible strands being able to expand and contract lengthwise to resist breaking due to pulling of the item;

each of the first mooring pin and the second mooring pin having a narrower portion passing through the respective housing aperture and a portion wider than the respective housing aperture having an aperture in that wider portion, a non-elastic strand attached to each aperture in each wider portion so that each strand extends between the housings to restrict the extent of expansion of the strands.

* * * * *